US006817918B2

(12) United States Patent
Claus et al.

(10) Patent No.: US 6,817,918 B2
(45) Date of Patent: Nov. 16, 2004

(54) HYBRID SEALING TECHNIQUE

(75) Inventors: Holger Claus, Lake Forest, CA (US); Randal S. Kincade, Irvine, CA (US); Steven Osowski, Wildomar, CA (US)

(73) Assignee: Ushio America, Inc., Cypress, CA (US)

( * ) Notice: Subject to any disclaimer, the term of this patent is extended or adjusted under 35 U.S.C. 154(b) by 265 days.

(21) Appl. No.: 09/877,880

(22) Filed: Jun. 8, 2001

(65) Prior Publication Data

US 2002/0187710 A1 Dec. 12, 2002

(51) Int. Cl.[7] ..... H01J 9/00; H05B 33/10
(52) U.S. Cl. ..... 445/26; 445/27
(58) Field of Search ..... 445/26, 27

(56) References Cited

U.S. PATENT DOCUMENTS 2,716,584 A * 8/1955 Retzer ..... 445/33
3,685,880 A * 8/1972 Sobieski ..... 445/26
5,984,749 A * 11/1999 Nishibori et al. ..... 445/26
6,354,900 B1 * 3/2002 Ohshima et al. ..... 445/26

* cited by examiner

*Primary Examiner*—Thomas M. Sember
*Assistant Examiner*—Peter Macchiarolo
(74) *Attorney, Agent, or Firm*—J. D. Harriman, II, Esq.; Coudert Brothers LLP

(57) ABSTRACT

The present invention is a hybrid sealing technique. According to one or more embodiments of the present invention, an unsealed lamp body is heated and a partial pinch seal is performed on a first side of the lamp body at an outer junction area. Then, a shrink seal is applied which completes the sealing process at the first side of the lamp body by sealing an inner junction area on the same side of the lamp body. The present invention retains the benefits of the shrink seal, but alleviates the difficulty associated with holding the electrode assemblies in place when performing a traditional shrink seal. In addition, the machine which holds the electrode assemblies in place is greatly simplified.

5 Claims, 5 Drawing Sheets

HYBRID SEALING TECHNIQUE

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND OF THE INVENTION

1. Field of the Invention

The present invention relates to the manufacture of lamps, and in particular to a hybrid sealing technique that enhances productivity when manufacturing the lamps.

2. Background Art

When manufacturing lamps, two electrodes are typically sealed within a lamp body to form a sealed enclosure where light is produced. Two methods are typically used to seal the enclosure. A first method is a pinch seal. A second method is a shrink seal. Shrink seals are superior to pinch seals, but it is difficult to position the electrodes and to secure them in place when performing a shrink seal.

Typical Lamp Configuration

A typical lamp configuration is shown in FIG. 1 where lamp body 5 contains a first electrode 15 and a second electrode 20 which are located opposite one another and which are respectively connected to a molybdenum foil part 25 and a molybdenum foil part 30. The connections between first electrode 15 and second electrode 20 and foil parts 25 and 30 are maintained by inner junction 80 and inner junction 85 within hermetically sealed portions 45 and 50 respectively. In addition, molybdenum wires 55 and 60 are connected to foil parts 25 and 30 by outer junctions 90 and 95.

Pinch Seal

To form a pinch seal, the lamp body 5, which may be comprised of quartz glass or other suitable material, is heated. When heated, the lamp body 5 becomes malleable. Pressure is applied in the area of foil parts 25 and 30 to pinch the malleable glass to the foil parts which creates a vacuum tight seal where junctions 35 and 90 are sealed at the same time. Pinch seals are disadvantageous because it is essential to not only seal the lamp but to also clean all impurities from the inside of the lamp before sealing it. Pinch seals offer no mechanism to effectively clean the sealed inside portion of the lamp. In addition, the pinch seal causes a large amount of pressure to the lamp body and electrode assemblies and the seal is often non-uniform which can lead to premature lamp failures and limits the pressure the lamps can be operated with.

Shrink Seal

To form a shrink seal, the unsealed lamp body is placed in a vacuum as shown in FIG. 2. To perform a shrink seal, the glass lamp body 200 is heated and a vacuum pumps pressure in opposing directions 210 and 220 which cause the lamp body to shrink and seal around foil parts 230 and 240. Shrink seals are beneficial because the vacuum pressure that pulls air from the inside of the lamp body also pulls impurities from the lamp body as well. Moreover, this type of seal is advantageous since a better glass uniformity around junctions 35 and 40 can be achieved. This leads to better reliability and better maintenance. When performing a shrink seal, it is crucial to position the electrode and to secure the electrode assembly in place.

To position and hold the electrode assembly in place while performing a shrink seal is an expensive and difficult process because a machine must be used to hold the electrode assemblies at the molybdenum wire portions 55 and 60 and to adjust the position of the molybdenum wires 55 and 60 so that the entire electrode assembly is positioned exactly in the right position when the shrink seal is achieved. In addition, the positioning of the electrode assembly must occur in vacuum conditions which makes the process even more difficult.

SUMMARY OF THE INVENTION

The present invention is a hybrid sealing technique. According to one or more embodiments of the present invention, an unsealed lamp body is heated and a partial pinch seal is performed on one side of the lamp body at an outer junction area. Then, a shrink seal is applied to that portion of the lamp body to completely seal the electrode within the lamp body by sealing an inner junction area.

In one embodiment, Nitrogen is flushed through the unsealed lamp body from the bottom of the lamp and over the electrodes to avoid oxidation and clean the lamp. In other embodiments, an inert gas like Argon, Neon, or other suitable gas is used. Then, the glass is heated and a partial pinch seal is performed at the bottom portion of the lamp only around an outer junction area. After that, a vacuum at the top of the lamp body pulls air out. Thereafter the glass is allowed to cool for a short time, 5 seconds for instance. Then, a burner is turned on and moved up the length of the area to be sealed (near the partially pinch sealed area) and in conjunction with the vacuum this causes the glass to soften and a shrink seal is achieved around an inner junction area.

The present invention retains the benefits of the shrink seal, but alleviates the difficulty associated with holding the electrode assemblies in place when performing a traditional shrink seal in vacuum conditions. In addition, the machine which holds the electrode assemblies in place is greatly simplified since the partial pinch seal holds the electrode in place while the shrink seal is occurring.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

The invention relates to a hybrid sealing technique. In the following description, numerous specific details are set forth to provide a more thorough description of embodiments of the invention. It will be apparent, however, to one skilled in the art, that the invention may be practiced without these specific details. In other instances, well known features have not been described in detail so as not to obscure the invention.

Figure 1:
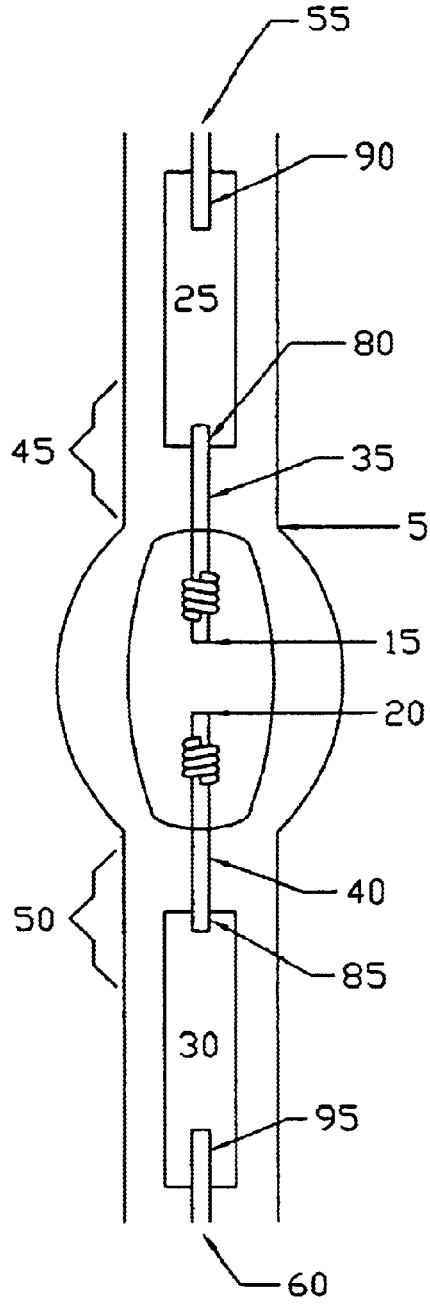
Figure 1 (Prior Art)
FIG. 1 is a diagram of a typical lamp configuration.
Figure 2:
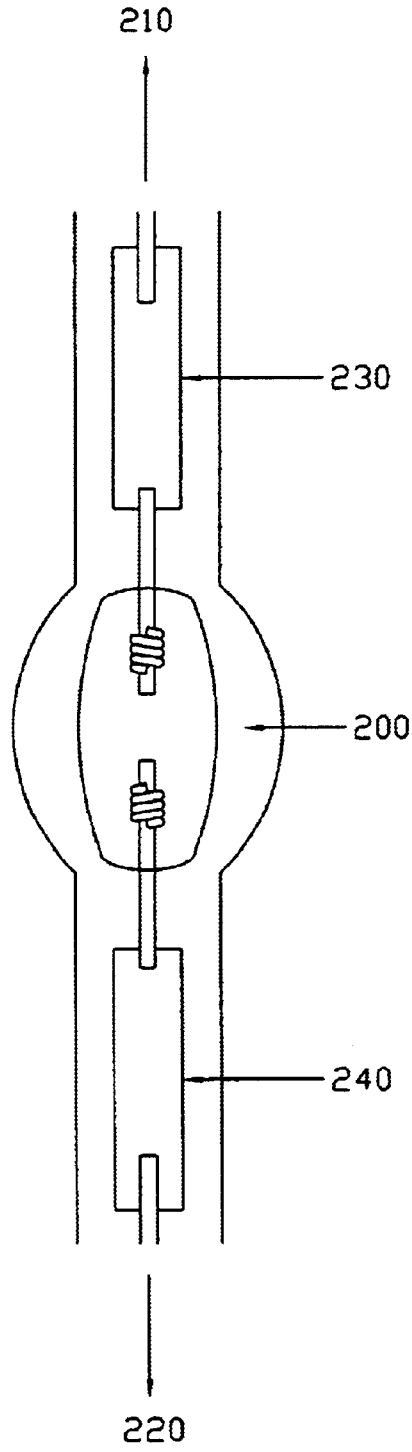
Figure 2 (Prior Art)
FIG. 2 is a diagram of a typical shrink seal.
Figure 3:
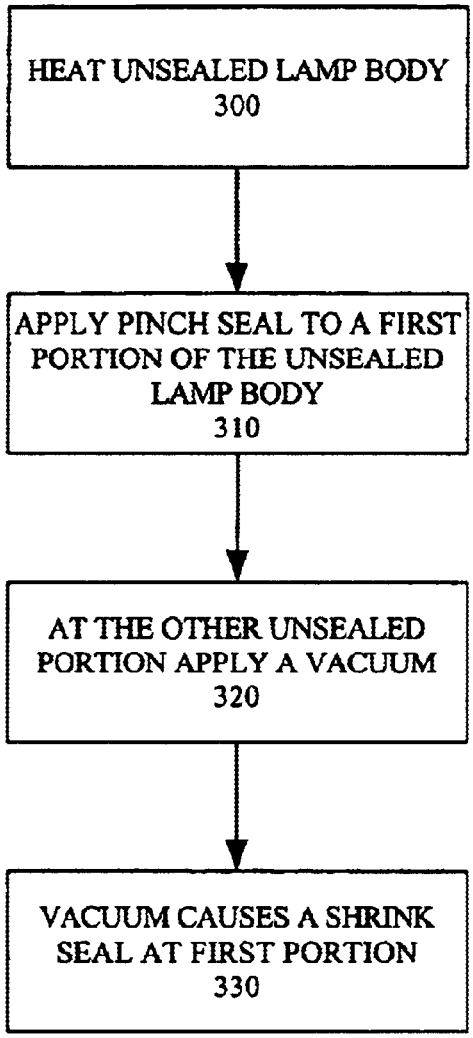
FIG. 3 is a flowchart showing a hybrid sealing technique according to an embodiment of the present invention.

According to one or more embodiments of the present invention, an unsealed lamp body is heated and a partial pinch seal is performed on one side of the lamp body in a junction area between a foil part and a molybdenum wire (outer junction area). Then, a shrink seal is applied to the same side of the lamp body to complete the seal at an inner junction area where the electrode joins the foil part. An embodiment of the present invention is described in FIG. 3. At step 300 an unsealed lamp body is heated. Then, a partial pinch seal is applied at step 310 to an outer junction area on a first side of the unsealed lamp body. Next, a vacuum is applied in one direction at a second side of the lamp body at step 320. Thereafter, the vacuum causes a shrink seal to the first side at an inner junction which completes the hybrid sealing process for that side of the lamp body.

Figure 4:
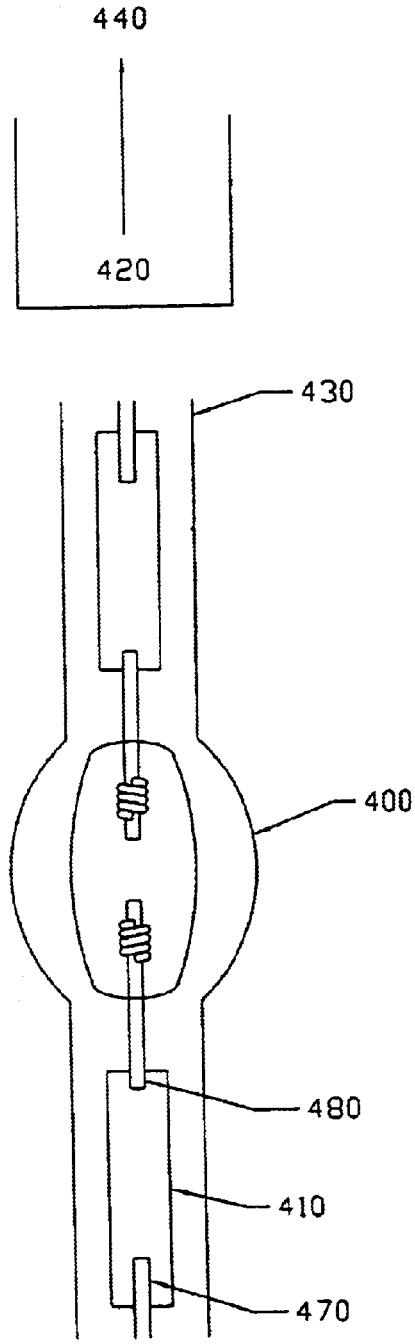
FIG. 4 is a diagram of a hybrid sealing technique according to an embodiment of the present invention.

FIG. 4 is a diagram of the process of performing the hybrid sealing technique. Lamp body 400 is heated which causes the body to soften. Then, a first unsealed portion 410 is partially pinch sealed at junction 470. Then, a vacuum 420 is applied to a second portion 430 of the lamp body 400 which remains unsealed. Vacuum 420 pulls air from lamp body 400 in the direction indicated by arrow 440. Thereafter, the vacuum pressure in conjunction with the lamp body which has been softened by heating causes a shrink seal to occur at a second junction area 480.

Figure 5:
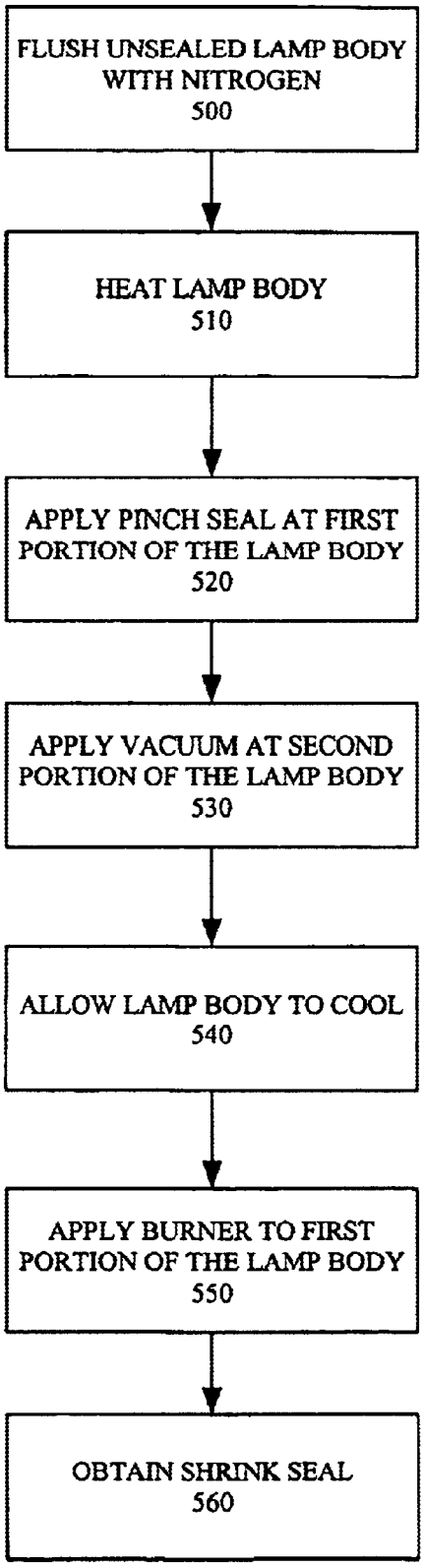
FIG. 5 is a flowchart showing a hybrid sealing technique according to another embodiment of the present invention.

In one embodiment, Nitrogen is used to clean the lamp body before a hybrid sealing technique is applied. This embodiment of the present invention is shown in the flowchart of FIG. 5. At step 500 Nitrogen is flushed through the unsealed lamp body from the bottom of the lamp and over the electrodes to avoid oxidation and clean the lamp. In other embodiments, an inert gas like Argon, Neon, or other suitable gas is used. Then, at step 510 the lamp body is heated and a partial pinch seal is performed at the bottom portion of the lamp body at step 520. After that, a vacuum at the top of the lamp body pulls air out at step 530. Thereafter, at step 540, the glass is allowed to cool for a short time, 5 seconds for instance. Then, a burner is turned on and moved up the length of the bottom portion at step 550. The application of the burner in conjunction with the vacuum causes the glass to soften and a shrink seal is achieved on the bottom portion of the lamp body at step 560.

The present invention retains the benefits of the shrink seal, but alleviates the difficulty associated with holding the electrode assemblies in place under vacuum conditions when performing a traditional shrink seal. In addition, the machine which holds the electrode assemblies in place is greatly simplified. Thus, a hybrid sealing technique is described in conjunction with one or more specific embodiments. The invention is defined by the claims and their full scope of equivalents.

What is claimed is:

1. A method for sealing a lamp comprising:

applying a first heating step to said lamp;

performing a partial pinch seal on a first portion of said lamp at an outer junction area;

applying a vacuum to a second portion of said lamp;

applying a cooling step to said lamp; and applying a second heating step to said lamp wherein said second heating step in conjunction with said vacuum causes a shrink seal to occur at said first portion of said lamp at an inner junction area.

2. The method of claim 1 wherein said outer junction area extends over a molybdenum wire and a foil part.

3. The method of claim 1 wherein said inner junction area extends over an electrode and a foil part.

4. The method of claim 1 further comprising: flushing said lamp with Nitrogen, Argon, or Neon.

5. The method of claim 1 wherein said lamp is made of a quartz glass.

* * * * *